US006460637B1

(12) United States Patent
Siracki et al.

(10) Patent No.: US 6,460,637 B1
(45) Date of Patent: Oct. 8, 2002

(54) ENGINEERED ENHANCED INSERTS FOR ROCK DRILLING BITS

(75) Inventors: Michael A. Siracki; Chris E. Cawthorne, both of The Woodlands; Per I. Nese, Houston, all of TX (US); Madapusi K. Keshavan, Sandy, UT (US); J. Daniel Belnap, Pleasant Grove, UT (US); Ronald K. Eyre, Orem, UT (US); Nathan R. Anderson, Pleasant Grove, UT (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/707,612

(22) Filed: Nov. 7, 2000

Related U.S. Application Data

(62) Division of application No. 09/023,264, filed on Feb. 13, 1998, now Pat. No. 6,199,645.

(51) Int. Cl.[7] ..... E21B 10/36
(52) U.S. Cl. ..... 175/430; 175/426
(58) Field of Search ..... 175/428, 430, 175/431, 426, 374

(56) References Cited

U.S. PATENT DOCUMENTS

| | | | | |
|---|---|---|---|---|
| 4,109,737 | A | 8/1978 | Bovenkerk | 175/329 |
| 4,592,433 | A | 6/1986 | Dennis | 175/329 |
| 4,604,106 | A | 8/1986 | Hall et al. | 51/293 |
| 4,694,918 | A | 9/1987 | Hall | 175/329 |
| 4,705,124 | A | 11/1987 | Abrahamson ert al. | 175/410 |
| 4,764,434 | A | 8/1988 | Aronsson et al. | 428/565 |
| 4,811,801 | A | 3/1989 | Salesky et al. | 175/329 |
| 5,131,481 | A | 7/1992 | Smith | 175/428 |
| 5,154,245 | A | 10/1992 | Waldenström et al. | 175/420.2 |
| 5,217,081 | A | 6/1993 | Waldenström et al. | 175/420.2 |
| 5,335,738 | A | 8/1994 | Waldenström et al. | 175/420.2 |
| 5,351,772 | A | 10/1994 | Smith | 175/428 |
| 5,353,885 | A | 10/1994 | Hooper et al. | 175/378 |
| 5,370,195 | A | 12/1994 | Keshavan et al. | 175/420.2 |
| 5,379,854 | A | 1/1995 | Dennis | 175/434 |
| 5,435,403 | A | 7/1995 | Tibbitts | 175/432 |
| 5,469,927 | A | 11/1995 | Griffin | 175/432 |
| 5,499,688 | A | 3/1996 | Dennis | 175/426 |
| 5,524,719 | A | 6/1996 | Dennis | 175/432 |
| 5,544,713 | A | 8/1996 | Dennis | 175/434 |
| 5,566,779 | A | 10/1996 | Dennis | 175/426 |
| 5,592,995 | A | 1/1997 | Scott et al. | 175/374 |
| 5,598,750 | A | 2/1997 | Griffin et al. | 76/108.2 |
| 5,605,199 | A | 2/1997 | Newton | 175/432 |
| 5,709,279 | A | 1/1998 | Dennis | 175/430 |
| 5,711,702 | A | 1/1998 | Devlin | 451/540 |
| 5,743,346 | A | 4/1998 | Flood et al. | 175/420.2 |
| 5,788,001 | A | 8/1998 | Matthias et al. | 175/432 |
| 5,816,347 | A | 10/1998 | Dennis et al. | 175/432 |
| 5,871,060 | A | 2/1999 | Jensen et al. | 175/420.2 |
| 5,881,828 | A * | 3/1999 | Fischer et al. | 175/374 |
| 5,888,619 | A | 3/1999 | Griffin | 428/172 |
| 5,890,552 | A | 4/1999 | Scott et al. | 175/426 |
| 5,906,246 | A | 5/1999 | Mensa-Wilmot et al. | 175/432 |
| 5,979,577 | A | 11/1999 | Fielder | 175/431 |
| 6,000,483 | A | 12/1999 | Jurewicz et al. | 175/428 |
| 6,011,232 | A | 2/2000 | Matthias | 219/69.17 |

FOREIGN PATENT DOCUMENTS

| | | |
|---|---|---|
| EP | 0257869 | 3/1988 |
| GB | 2279093 | 12/1994 |
| GB | 2279094 | 12/1994 |

* cited by examiner

*Primary Examiner*—David Bagnell
*Assistant Examiner*—John Kreck
(74) *Attorney, Agent, or Firm*—Christie, Parker & Hale, LLP

(57) ABSTRACT

Enhanced inserts are formed having a cylindrical grip and a protrusion extending from the grip. An ultra hard material layer is bonded on top of the protrusion. The inserts are mounted on a rock bit and contact the earth formations off center. The ultra hard material layer is thickest at a critical zone which encompasses a major portion of the region of contact between the insert and the earth formation. Transition layers may also be formed between the ultra hard material layer and the protrusion so as to reduce the residual stresses formed on the interface between the ultra hard material and the protrusion.

20 Claims, 13 Drawing Sheets

830
874
812

830
849
850
874
828

830
874
876

830
858
828
8E
8E 830
874
828
858

830
858

ENGINEERED ENHANCED INSERTS FOR ROCK DRILLING BITS

CROSS-REFERENCE TO RELATED APPLICATION

This application is a Divisional application of U.S. patent application Ser. No.09/023,264, filed on Feb. 13, 1998 now U.S. Pat. No. 6,199,645.

BACKGROUND OF THE INVENTION

Earth boring bits for drilling oil and gas such as rotary conical bits or hammer bits incorporate carbide inserts as cutting elements. To improve their operational life, these inserts are preferably coated with an ultra hard material such as polycrystalline diamond. Typically, these coated inserts are not used throughout the bit. For example, diamond coated inserts are used to form the gage row 2 in roller cones 4 of a roller cone bit 3 (FIG. 11), or the gage row 1202 of a percussion bit 1203 (FIG. 12A). The inserts typically have a body consisting of a cylindrical grip from which extends a convex protrusion. The protrusion, for example, may be hemispherical, commonly referred to as a semi-round top (SRT), or may be conical, or chisel-shaped and may form a ridge that is skewed relative to the plane of intersection between the grip and the protrusion.

When installed in the gage area, for example, these inserts typically contact the earth formation away from their central axis 32 at a location 8 as can be seen with insert 5 on FIG. 11. The interfacial region between the diamond and the substrate is inherently weak in a diamond coated insert due to the thermal expansion mismatch of the diamond and carbide substrate materials. As a result, diamond coated inserts tend to fail by delamination of the diamond layer, either by cracks initiating along the interface and propagating outward, or by cracks initiating in the diamond layer surface and propagating catastrophically along the interface.

Two approaches have been used to address the delamination problem. One approach is to significantly increase the surface area of the interface through the use of corrugated or "non-planar" interfaces, which have the claimed effect of reorienting and reducing the interfacial stresses over the entire protrusion surface. The other approach uses transition layers, made of materials with thermal and elastic properties intermediate between the ultra hard material layer and the substrate, applied over the entire protrusion surface. These transition layers have the effect of reducing the residual stresses at the interface, thus, improving the resistance of the inserts to delamination. When the delamination problems, however, have been solved, new enhanced insert failure modes are introduced which are highly localized to the regions of the applied stress. These new failure modes involve complex combinations of three mechanisms. These mechanisms are wear of the PCD, surface initiated fatigue crack growth, and impact-initiated failure.

The wear mechanism occurs due to the relative sliding of the PCD relative to the earth formation, and its prominence as a failure mode is related to the abrasiveness of the formation as well as other factors such as formation hardness or strength, and the amount of relative sliding involved during contact with the formation.

The fatigue mechanism involves the progressive propagation of a surface crack, initiated on the PCD layer, into the material below the PCD layer until the crack length is sufficient for spalling or chipping.

The impact mechanism involves the sudden propagation of a surface crack or internal flaw initiated on the PCD layer, into the material below the PCD layer until the crack length is sufficient for spalling, chipping, or catastrophic failure of the enhanced insert.

The impact, wear and fatigue life of the diamond layer may be increased by increasing the diamond thickness and thus, the diamond volume. However, the increase in diamond volume results in an increase in the magnitude of residual stresses formed on the diamond/substrate interface which foster delamination. This increase in the magnitude of the residual stresses is believed to be caused by the difference in the thermal contractions of the diamond and the carbide substrate during cool-down after the sintering process. During cool-down after the diamond bonds to the substrate, the diamond contracts a smaller amount then the carbide substrate resulting in residual stresses on the diamond/substrate interface. The residual stresses are proportional to the volume of diamond in relation to the volume of the substrate.

Both the fatigue and impact failure mechanisms involve the development and propagation of Hertzian ring cracks which develop around at least part of the periphery 1279 of the contact area 1280 with the earth formation (FIG. 12B). This part of the periphery of the contact area is referred to herein as the "critical contact region" of the insert and is denoted by reference numeral 1279 in FIG. 12B. These ring cracks which develop in the critical contact region typically propagate in a stable manner through the ultra hard material layer in a direction away from the contact region. Microscopic examination of inserts which have been used in drilling applications show that it is not the development of surface cracks in the PCD which limits the useful life of the cutting element, but rather the impact or fatigue induced propagation of these surface cracks into the substrate material which limits the useful life of the inserts.

There is, therefore. a need for an insert with increased resistance to the localized wear, fatigue and impact resistance mechanisms so as to have an enhanced operating life. To solve this need, the inserts of the present invention have an increased thickness of diamond in the critical contact region.

In efforts to increase insert cutting life, applicants discovered that it is advantageous to place thicker PCD in the critical contact region and in areas immediately outside the contact area where fatigue or impact induced crack growth is of primary concern. In practical drilling applications, the critical contact region can vary substantially due to the intrinsic variations in depth of contact with the earth formation during drilling. These variations in the depth of contact may be due to, for example, the inhomogeneity in the formation, and the weight on the bit. Because of this variation, it was found necessary to place the thicker PCD in a certain defined region rather than at a single location. This defined region includes the critical contact region and is referred to herein for descriptive purposes as the "critical zone." Moreover, by limiting the thicker diamond to a defined region, the increase in the volume of the diamond is minimized, therefore minimizing the increase in residual stresses.

The prior art does not disclose such an insert. For example, U.S. Pat. Nos. 5,379,854 and 5,544,713 disclose inserts having a corrugated interface between the diamond and the carbide support. These corrugated interfaces create a step wise transition between the two materials which serves as structural reinforcement for the transfer of shear stress from diamond to the carbide and thus, reducing the amount of the shear stress which is placed on the bond line between the diamond and the carbide. Moreover, the corrugated interface reduces the thermally induced stresses on the interface of the diamond and carbide due to the mismatch in the coefficient of thermal expansion between the two materials.

To increase the resistance to cracking, chipping and wear of the diamond layer of the insert, U.S. Pat. No. 5,335,738, discloses an insert having a carbide body having a core containing eta-phase surrounded by a surface zone free of eta-phase. It is believed that this multi-structure insert body causes a favorable distribution of the stresses created by the coefficient of thermal expansion mismatch between the diamond and the carbide. Moreover, the '738 patent discloses depressions on the protrusion of the insert body beneath the diamond layer. These depressions are filled with diamond material different than the diamond material which makes up the diamond layer in cutting elements.

Neither of the '854, '713, or '738 patents teach a way of overcoming the localized failure modes nor do they teach the placement of an increased thickness of diamond on the area of contact between the diamond and the earth formation.

SUMMARY OF THE INVENTION

This invention relates to enhanced inserts mounted on a rock bit, preferably in the bit's gage row for contacting earth formations off center. The inserts have a grip from which extends a convex protrusion which is coated with an ultra hard material such as polycrystalline diamond (PCD). The ultra hard material layer has a maximum thickness within the critical zone.

In some embodiments, the inserts have an axisymmetric protrusion on which is bonded an ultra hard material layer having an axisymmetric outer surface. In alternate embodiments, the insert protrusions are non-axisymmetric and the ultra hard material layers have outer surfaces which are axisymmetric. In other embodiment, the inserts have protrusions which are non-axisymmetric and the ultra hard material layer outer surfaces are also non-axisymmetric. In yet further embodiments, the inserts have protrusions which are axisymmetric and ultra hard material layers which have non-axisymmetric outer surfaces. With any of these embodiments, the portions of the protrusions within the critical zone may be linear, convex or concave in cross-section. Furthermore, transition layers may be incorporated between the protrusion and the ultra hard material layer in any of the embodiments. The transition layers may have grooves formed on their outer surfaces that are aligned with the critical zone. In addition, the portion of the protrusions and/or the portion of the transition layers, if incorporated, within the critical zone may be textured.

In another embodiment, a first groove is formed on a leading surface of the protrusion within the critical zone. A second groove or oval depression is formed on the trailing surface of the protrusion less than 180° from the front surface of the protrusion. A transition layer is then formed on top of the protrusion and grooves and is draped within the grooves. An ultra hard material layer is then formed on top of the transition layer having a uniform outer surface. As such, the diamond layer is thickest in the areas of the grooves.

In yet another embodiment, the insert has a non-axisymmetric protrusion. A ridge is formed on the protrusion that is skewed relative to the plane of intersection between the protrusion and the grip. A stepped down depression is formed on the protrusion and is located within the critical zone. The depression is widest at the surface of the protrusion and is stepped down incrementally along the depth of the depression. Transition layers may be formed within each step in the depression. An ultra hard material layer which has an outer surface conforming to the outer shape of the protrusion is formed on top of the transition layers. Alternatively, the protrusion is filled only with ultra hard material.

DETAILED DESCRIPTION

Figure 1A:
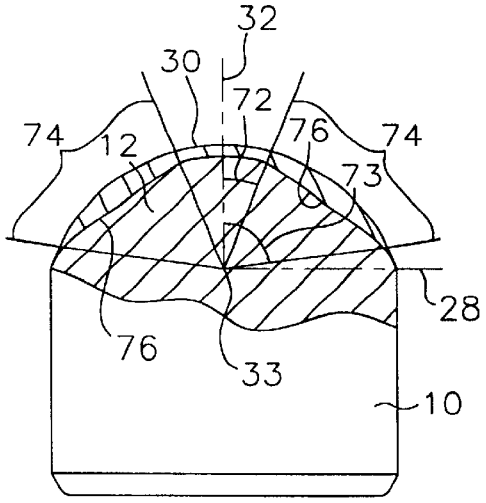
FIG. 1A depicts a partial cross-sectional view of an insert having an axisymmetric protrusion on which is bonded an ultra hard material layer having an axisymmetric outer surface, wherein the protrusion surface within a critical zone is linear in cross-section.

Enhanced inserts for use in rock bits for drilling (i.e., boring) earth formations typically have a cylindrical grip section 10 from which extends a convex protrusion 12 (see for example, FIG. 1A). The convex protrusion may be axisymmetric, as for example, hemispherical (commonly referred to as semi-round top or SRT) or conical. The protrusion may also be non-axisymmetric, as for example, chisel-shaped and may form a ridge that is skewed relative to the plane of intersection 28 between the grip and the protrusion. The protrusions, which may be coated with an ultra hard material, are the part of the inserts that typically contact the earth formation being drilled. The inserts are typically made from a carbide material.

Figure 11:
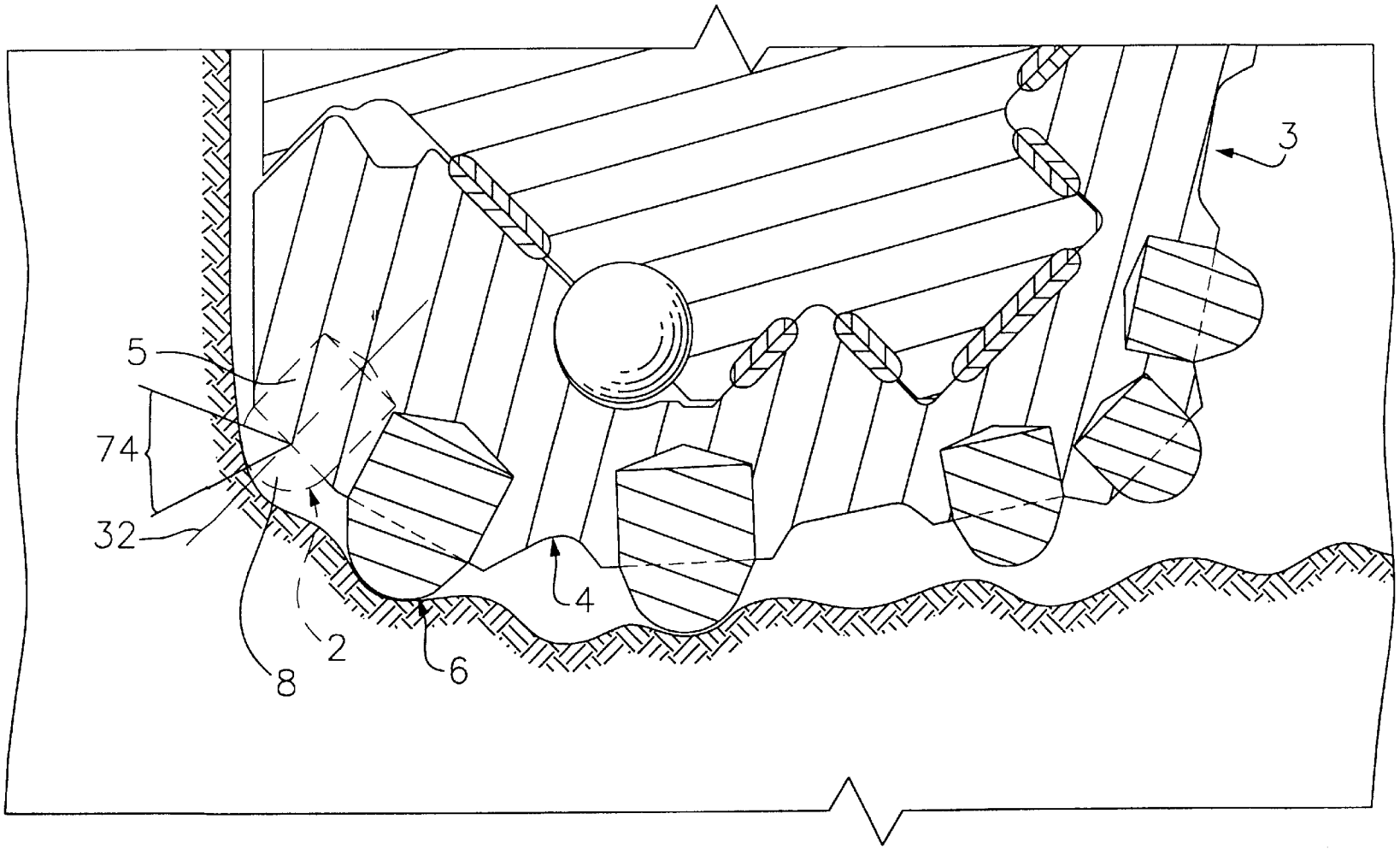
FIG. 11 is a cross-sectional view of part of a roller cone bit depicting the gage row of inserts.
Figure 12A:
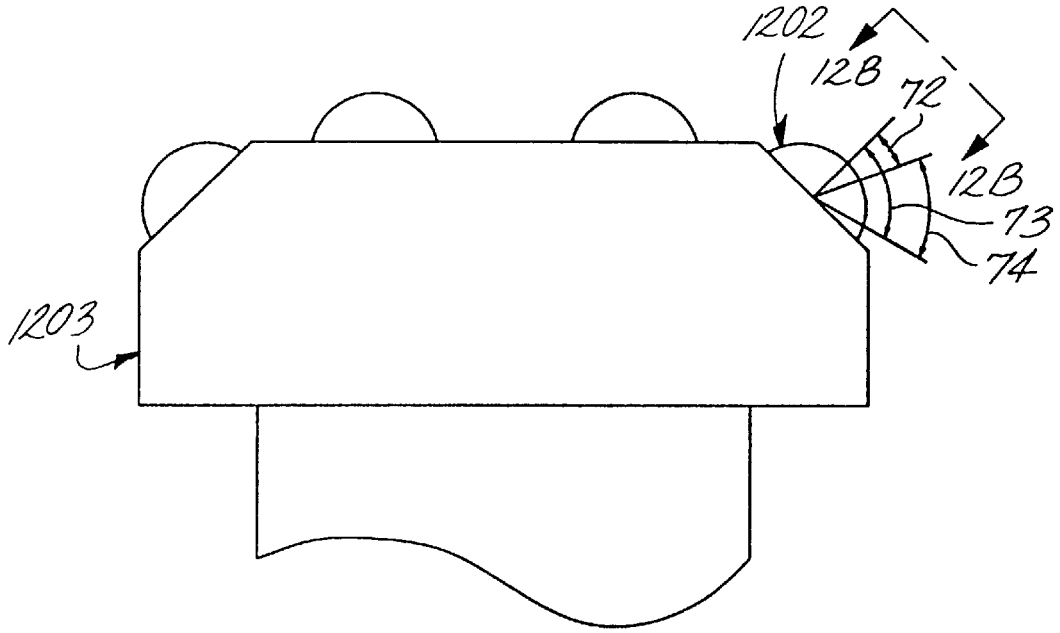
FIG. 12A is a partial side view of part a percussion bit.

The present invention is directed to such enhanced inserts having an ultra hard material layer, such as a polycrystalline diamond (PCD) layer, formed on the protrusion, wherein the ultra hard material layer is thickest within a defined critical zone. For illustrative purposes the present invention is described with PCD as the ultra hard material layer. As such, and for convenience, PCD is used herein throughout this application to refer to polycrystalline diamond or any other ultra hard material, such polycrystalline cubic boron nitride (PCBN). The inserts of the present invention are designed for contacting earth formations off-center. For example, these inserts may be mounted on the gage row 1202 of a roller cone in a rock bit (FIG. 11) or in the gage row in a percussion bit (FIG. 12A).

Figure 12B:
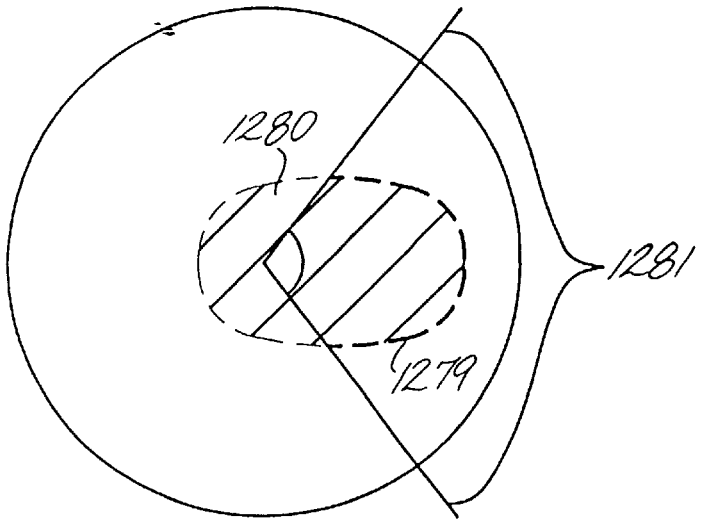
FIG. 12B is a top view of an insert mounted on the gage row of a percussion bit depicting the contact region of the insert protrusion.

Sections from enhanced inserts that have been used in drilling show that the PCD cracks are typically Hertzian ring cracks that develop around part of the periphery 1279—referred to herein as the "critical contact region"—of the region of contact 1280 with the formation (FIG. 12B). The cracking is usually more severe on the portion of the insert which is closest to the hole wall during drilling. It is difficult to determine where the periphery of the region of contact and thus, the critical contact region, may be for a given application due to unpredictable factors encountered during drilling. In addition, in a roller cone bit application, the region of contact changes as the bit rotates from the region of initial contact (leading edge) to a region of final contact (trailing edge). Given the difficulty in predicting the periphery of the region, it is best to describe a range of angles within which the critical contact region may be located. Specifically, the angles are measured from the insert central axis 32 (FIG. 1A) as rotated about the point of intersection 33 between the central axis and the plane of intersection 28 between the grip and the protrusion. This range of angles, referred to herein as $\theta_{cr}$ in essence defines a critical zone 74 and has as its boundaries a first angle 72 (referred to herein as $\theta_1$) and a second angle 73 (referred to herein as $\theta_2$). In most instances, it has been discovered that $\theta_1$ is about 20° and $\theta_2$ is about 80° such that $\theta_{cr}$ is about 60°. Stated differently in most instances, the Hertzian cracks will form within this critical zone.

While the critical contact region typically does not span more than 180° around the protrusion, the critical contact zone may be defined to span around the entire insert (i.e., be an annular critical zone). In many instances, the critical zone is limited to an area 1281 of 160° around the protrusion (FIG. 12B). All inserts of the present invention have a critical contact region within the critical zone defined by $\theta_1$ being greater than or equal to 20° and $\theta_2$ being less than or equal to 80°.

The onset of enhanced insert failure by wear of the PCD, surface initiated crack growth, or impact initiated failure is delayed using thicker PCD. For a failure involving pure wear, the benefit of thicker PCD is obvious, in that more PCD must be removed abrasively before failure can occur. The fatigue and impact-initiated failures are delayed because the crack propagation distance before failure is increased, thus increasing the number of cycles to which the PCD can be exposed before failure. The observations about the effect of a thicker PCD on the three aforementioned failure modes is supported by laboratory test results.

However, placing of an overall thicker PCD layer on an insert may lead to premature failure of the insert due to an increase in the magnitude of the residual stresses that develop at the interface between the PCD layer and the carbide insert body. This is explained by the fact that residual stresses in mutually constrained materials having a coefficient of thermal expansion mismatch (as is the case with PCD and cemented carbide) are proportional to the relative volumes of the materials involved. There is a delicate balance between the benefits achieved using a thicker PCD layer on an insert and the drawbacks due to the increased magnitude of the residual stresses developed. The inventors of the present invention have discovered that they can achieve an optimum balance by placing thicker PCD only in the specific regions of stress imposed by the drilling application i.e., the PCD layer is tailored so as to be thickest at the critical zone. This can be accomplished, for example, by using a similar volume of diamond as in the typical enhanced insert and redistributing the volume so that the diamond thickness is greatest within the critical zone and not as great at all areas outside the critical zone.

The thicker diamond along the contact zone is better able to absorb the energy of impact through sub-critical PCD crack growth and as such is more resistant to chipping. The increased thickness of PCD material on the critical zone also increases the ability of the insert to perform in applications where wear is a concern. Moreover, by using similar volumes of diamond as used in the standard inserts, the residual stresses formed at the interface between the diamond and the carbide of the inserts of the present invention are similar to the residual stresses formed in the standard inserts. In this regard, the inserts of the present invention provide for enhanced resistance to wear and chipping of the insert diamond surface without increasing the residual stresses at the interface between the diamond and the carbide and therefore, without increasing the occurrence of residual stress promoted insert failures.

A test was performed by the applicants to test the invention of placing thicker diamond in the region on the insert which contacts the earth formation during drilling. Two different enhanced insert designs were placed in the gage row 1202 of percussion bits 1203 (FIG. 12). The gage inserts on a percussion bit contact the earth formation off-axis at an angle between about 35° and 45° from the apex of the insert. The first insert design tested was the standard type where the thickest diamond was located at the apex of the insert. The second design incorporated the present invention in that the thickest diamond was located at approximately 40° from the apex in the region of contact between the earth and the insert. The following table depicts the thickness of the PCD in various locations on the protrusion as measured from the apex for the standard insert and the insert of the present invention. It should be noted that the outer PCD shapes of the standard inserts and the present invention inserts were identical.

| Angle (Degrees) | Standard Insert | Present Invention |
|---|---|---|
| 0 | 0.012 in. | 0.013 in. |
| 20 | 0.011 in. | 0.014 in. |

-continued

| Angle (Degrees) | Standard Insert | Present Invention |
|---|---|---|
| 40 | 0.009 in. | 0.015 in. |
| 50 | 0.008 in. | 0.010 in. |
| 60 | 0.006 in. | 0.006 in. |

The percussion bits having standard inserts in the gage row were able to drill an average of 1202 feet before failure of the inserts. The percussion bits having the inserts of the present invention on its gage row were able to drill an average of 2314 feet before insert failure. The test data revealed that the footage drilled was nearly doubled by use of off-axis thicker diamond.

To further enhance their operating life, the inventive inserts may also incorporate transition layers such as PCD/WC composites or PCBN which are strategically located for the purpose of reducing the residual stresses on the ultra hard material layer as well as on the insert. The transition layers tend to reduce the magnitude of the residual stresses that would otherwise form on the interface of the diamond with the protrusion. As a result, the operating life of the insert is increased.

A transition layer tends to reduce the residual stresses that are present when PCD is directly bonded to the substrate protrusion. High residual stresses may cause delamination of the PCD layer. To reduce the residual stresses, the transition layer should be selected from a material whose coefficient of thermal expansion is between the coefficient of thermal expansion of the PCD and the carbide substrate. Typically, two transition layers are employed. The first transition layer side interfaces with the PCD layer while its opposite side interfaces with the second transition layer. The second transition layer interfaces on one side with the first transition layer and on the other side with the substrate.

A first transition layer is preferably made from a material that is harder than the second transition layer and less hard than the PCD layer. An example of such material would be a material containing 71% by weight of pre-cemented tungsten carbide and 4% by weight of cobalt with the remaining portion being diamond. The second transition layer should preferably be made from a material that is less hard than the PCD layer and less hard than the first transition layer, but harder than the substrate material. An example of such material would be a material containing 85% by weight of pre-cemented tungsten carbide and 2% by weight of cobalt with the remainder being diamond.

As the diamond layer impacts the earth formation, shock waves are generated and are transmitted through the diamond layer to the carbide substrate. The shock created by the impact is known to cause delamination of the PCD layers in typical inserts. However, with a design incorporating transition layers, the impact shock is absorbed by the transition layers, thus reducing the occurrence of PCD layer delamination. Therefore, by using transition layers, the PCD layer is more resistant to delamination and as such, will tend to remain bonded to the insert for a longer time. Consequently, the operating life of the insert is increased.

It is also recommended that the maximum thickness of the PCD layer is between 0.01 times and 0.15 times the outside diameter of the grip portion of the insert when transition layers are used and between 0.015 times and 0.25 times the grip outside diameter when transition layers are not used. The increased thickness of the PCD also serves as an impact absorber.

Following are descriptions of enhanced inserts according to the present invention.

Figure 1C:
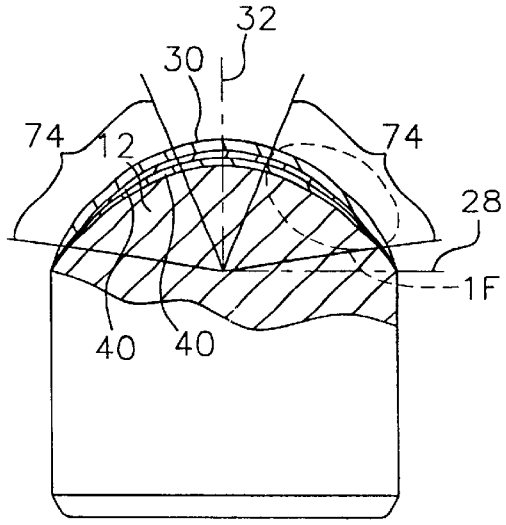
FIG. 1C depicts a partial cross-sectional view of an insert having an axisymmetric protrusion and an ultra hard material layer having an axisymmetric outer surface with a transition layer bonded between the protrusion and the ultra hard material layer.

In a first embodiment insert as shown in FIG. 1A, the protrusion 12 is axisymmetric. The portion of the protrusion within an annular critical zone 74 is linear in cross-section and forms an axisymmetric annular frustoconical band 76. In an alternate embodiment, the band 76 is convex in cross-section having a radius of curvature at a location within the critical zone that is different than the radius of curvature of the of the PCD layer outer surface at the same location within the critical zone (FIG. 1D). A PCD layer 30 is formed over the protrusion. The PCD layer outer surface is also axisymmetric so as to be the thickest within the critical zone. It should be noted that the thickness of the PCD layer outside the critical zone is less than the thickness within the critical zone.

Figure 1B:
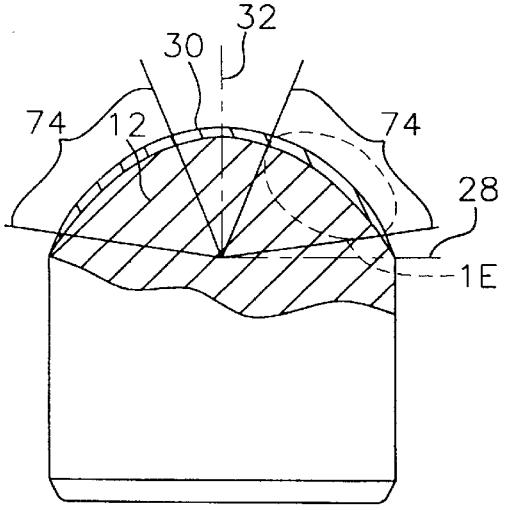
FIG. 1B depicts a partial cross-sectional view of an insert having an axisymmetric protrusion on which is bonded an ultra hard material layer having an axisymmetric outer surface, wherein the curvature of the ultra hard material layer outer surface is different than the curvature of the protrusion
Figure 1D:
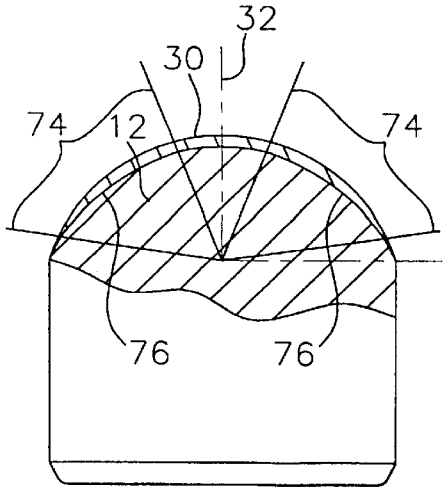
FIG. 1D depicts a partial cross-sectional view of an insert having an axisymmetric protrusion on which is bonded an ultra hard material layer having an axisymmetric outer surface, wherein the protrusion surface within a critical zone is convex in cross-section.

In another embodiment as shown in FIG. 1B, the protrusion is axisymmetric and the PCD layer outer surface is also axisymmetric having a curvature that is different than the curvature of the protrusion such that the thickness of the PCD layer is greatest within the annular critical zone 74. Again, at the thickness of the PCD layer outside the critical zone is less than the thickness of PCD within the critical zone. In the embodiments shown in FIGS. 1A, 1B and 1D, the maximum PCD thickness should preferably be not less than 0.015 times and no greater than 0.25 times the insert grip diameter.

A transition layer or multiple transition layers 40 as shown in FIG. 1C may be incorporated in either of the embodiments shown in FIGS. 1A, 1B and 1D. Preferably two transition layers are employed. When transition layers are incorporated, the thickness of the PCD layer should preferably be no less than 0.01 times and not greater than 0.15 times the insert grip diameter.

Figure 2A:
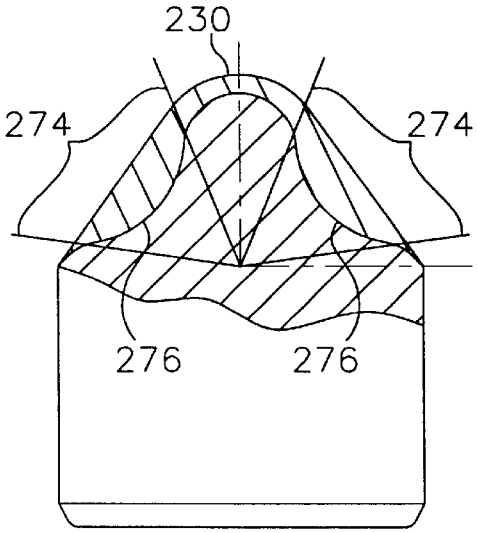
FIGS. 2A and 2B depict a partial cross-sectional view of an insert having an axisymmetric protrusion on which is bonded an ultra hard material layer having an axisymmetric outer surface, wherein the protrusion surface within a critical zone is concave in cross-section.

The insert shown in FIG. 2A, like the insert shown FIG. 1A has an axisymmetric protrusion on which is bonded a PCD layer 230 having an axisymmetric outer surface. The only difference between the two inserts is that the surface 276 of the protrusion within the annular critical zone 274 is concave. The concave surface 276 forms an axisymmetric band. As with the insert embodiment shown in FIG. 1A, this embodiment also provides that the PCD layer is thickest within the critical zone.

Figure 2B:
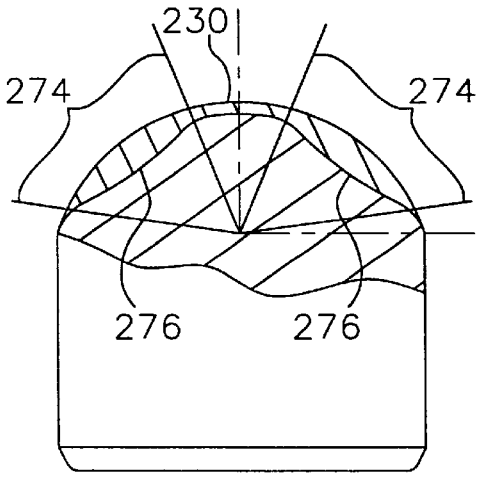

In another embodiment as shown in FIG. 2B, the protrusion is axisymmetric and the PCD layer 230 outer surface is also axisymmetric having a curvature that is different than the curvature of the protrusion such that the thickness of PCD is greatest within the critical zone 274. To further increase the thickness of the PCD layer within the critical region, the outer surface 276 of the protrusion within the critical zone is concave. Again, the concave surface forms an axisymmetric band on the protrusion outer surface. In the embodiments shown in FIGS. 2A and 2B, the PCD maximum thickness should preferably be not less than 0.015 times and no greater than 0.25 times the diameter of the insert grip.

Figure 2C:
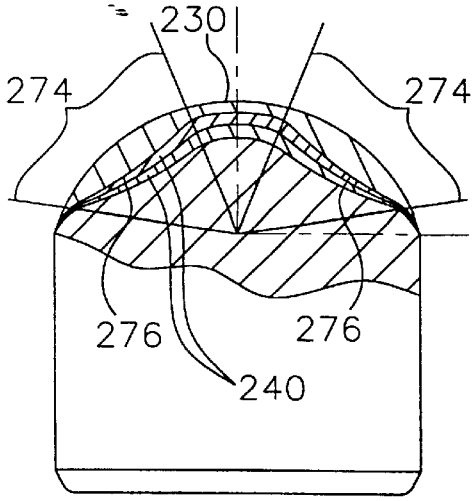
FIG. 2C is a partial cross-sectional view of an insert having an axisymmetric protrusion, wherein the protrusion surface within a critical zone is concave in cross-section and wherein a transition layer is bonded between the protrusion and the ultra hard material layer.

A transition layer or multiple transition layers 240 as shown in FIG. 2C may be incorporated in either of the embodiments shown in FIGS. 2A and 2B. Preferably two transition layers are employed. With the embodiment of FIG. 2B, the transition layers are placed within the concave surface 276 of the protrusion. When transition layers are incorporated, the maximum thickness of the PCD layer should preferably be no less than 0.01 times and not greater than 0.15 times the diameter of the insert grip.

Figure 3A:
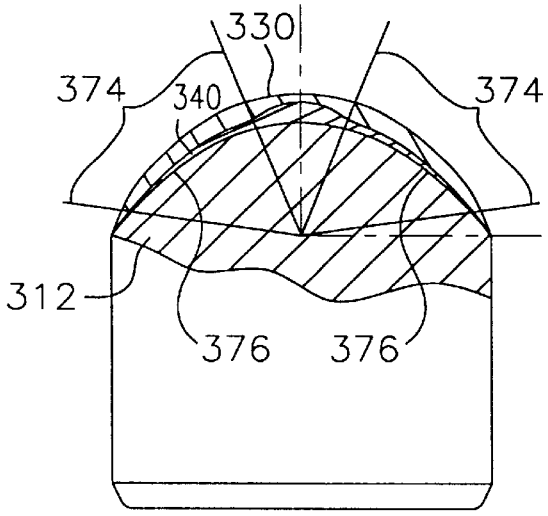
FIG. 3A is a partial cross-sectional view of an insert having an axisymmetric protrusion on which is formed a transition layer whose outer surface is concave within a critical zone, and an ultra hard material layer formed over the transition layer.

FIG. 3A depicts an insert having an axisymmetric protrusion 312. A first transition layer 340 is formed on top of the insert protrusions having a nonuniform axisymmetric outer surface. An axisymmetric groove 376 is formed on the outer surface of the first transition layer and is aligned with an annular critical zone 374. A PCD layer 330 is formed on top of the transition layer 340. The outer surface of the PCD layer is axisymmetric. The groove formed on the outer surface of the first transition layer and the curvature of the PCD outer surface ensure that the thickness of the PCD layer is greatest within the critical zone. The thickness of the PCD layer at any point outside the critical zone is less than the PCD layer thickness within the critical zone. In an alternate embodiment, the outer surface of the first transition layer is not axisymmetric nor is the groove 376.

Figure 3B:
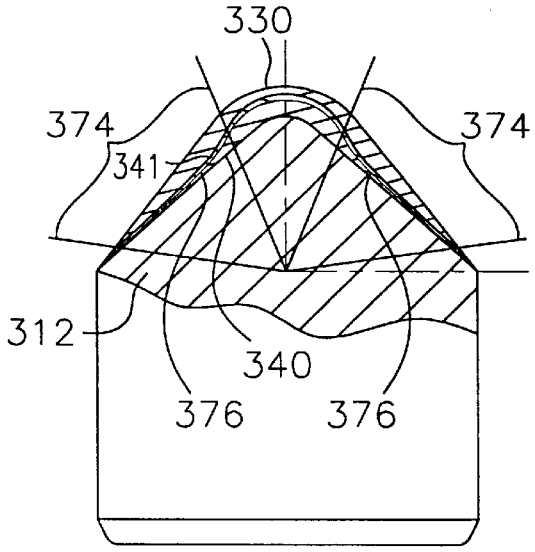
FIG. 3B is a partial cross-sectional view of the insert shown in FIG. 3A with an additional transition layer.

A first transition layer 341 may be formed over the second transition layer as shown in FIG. 3B. The second transition layer follows the contour of the first transition layer outer surface. An axisymmetric PCD layer 330 is then formed on top of the second transition layer. As it would become apparent to one skilled in the art, further transition layers may also be incorporated as long as the PCD layer is thickest at the critical zone. In alternate embodiments of the inserts shown in FIGS. 3A and 3B, the inserts may have non-axisymmetric protrusions.

Figure 4:
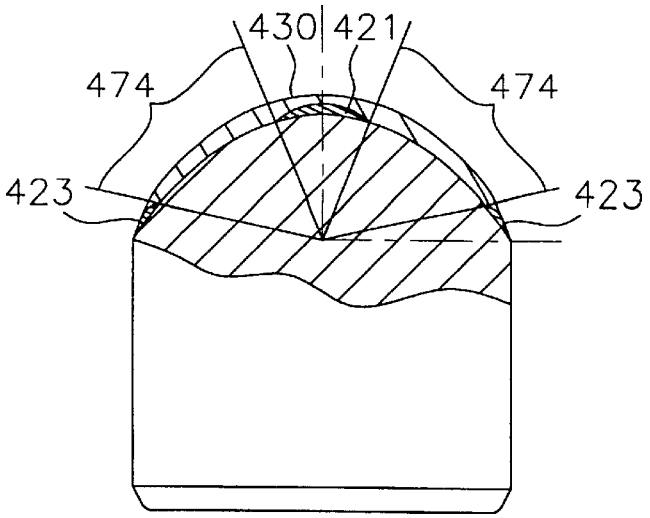
FIG. 4 is a partial cross-sectional view of an insert having an axisymmetric protrusion on which are formed two concentric spaced apart transition layers, wherein the portion of the protrusion outer surface within a critical zone is not covered by a transition layer, and an ultra hard material layer formed over the protrusion and transition layers.

FIG. 4 depicts an insert having an axisymmetric protrusion. Two concentric and spaced apart axisymmetric transition layers 421, 423 are formed on the protrusion. The surface of the protrusion within an annular critical zone 474 is not covered by any portion of any of the transition layers. A PCD layer 430 is formed on top of the transition layers and covers the protrusion. The outer surface of the PCD layer is also axisymmetric. The curvature of the outer surface of the PCD layer is chosen such that the PCD layer has the greatest thickness at the critical zone. The omission of a transition layer in the critical region also insures that the PCD layer is thickest at that zone. In alternate embodiments, more than two axisymmetric or non-axisymmetric transition layers may be incorporated. In further alternate embodiments, the protrusion may be non-axisymmetric. With these embodiments, the transition layers are non-axisymmetric, although the transition layer outer surfaces may be axisymmetric.

Although in the embodiments incorporating transition layers the PCD layer maximum thickness is preferably not less than 0.01 times and not greater than 0.15 times the insert grip diameter, in the embodiments shown in FIGS. 3A, 3B and 4, the PCD layer maximum thickness can be as great as 0.25 times and not less than 0.01 times the insert grip diameter.

Figure 5A:
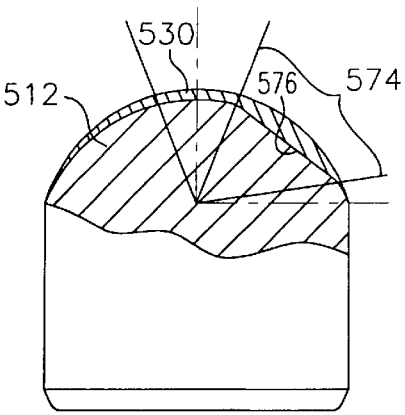
FIGS. 5A, 5B, 5C and 5D depict partial cross-sectional views of inserts having non-axisymmetric protrusions on which are bonded ultra hard material layers having axisymmetric outer surfaces, wherein the protrusion surfaces within a critical zone are either linear or convex in cross-section.
Figure 5B:
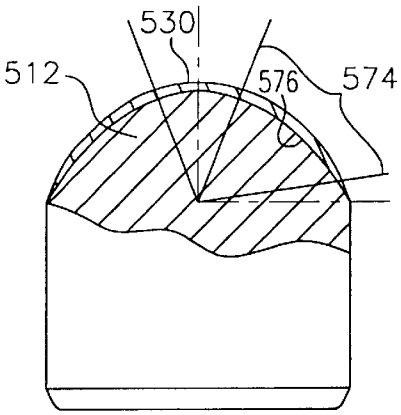

In the insert embodiment shown in FIG. 5A, the protrusion 512 is non-axisymmetric and has a critical zone 574 that spans around a portion of the protrusion. The portion of the protrusion within the critical zone is linear in cross-section forming a partial band 576. The critical zone may span 180° around the protrusion, but preferably spans a portion of the protrusion not greater than 160°. In an alternate embodiment, the portion of the protrusion 576 within the critical zone is convex in cross-section having a radius of curvature that is greater than the radius of the protrusion (FIG. 5B) immediately on either side of the critical zone. But for the band 576 that spans only a portion of the protrusion, the protrusion in otherwise axisymmetric. A PCD layer 530 is formed over the protrusion. The PCD layer outer surface is axisymmetric so as to have the greatest thickness within the critical zone. It should be noted that the thickness of the PCD layer outside the critical zone is less than the thickness within the critical zone.

Figure 5C:
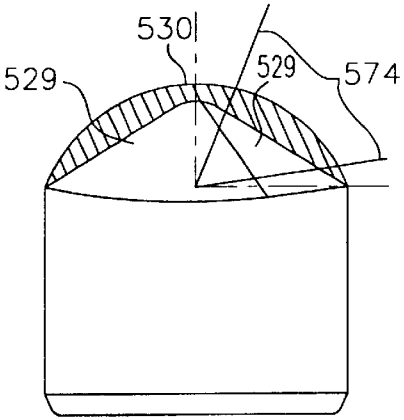

In another embodiment, shown in FIG. 5C, the protrusion of the insert has multiple flat sides 529 typically forming a pyramid. At least one of the flat sides is aligned with the critical zone which spans around a portion of the protrusion, typically no greater than 180°, but preferably no greater than 160°. A PCD layer 530 is bonded over the protrusion. The outer surface of the PCD layer is axisymmetric so as to have an increased PCD layer thickness along the flat sides and thus at the critical zone 574. The slope of the flat sides, as well as, the curvature of the PCD outer surface are tailored so as to maximize the PCD layer thickness along the critical zone 574.

Figure 5D:
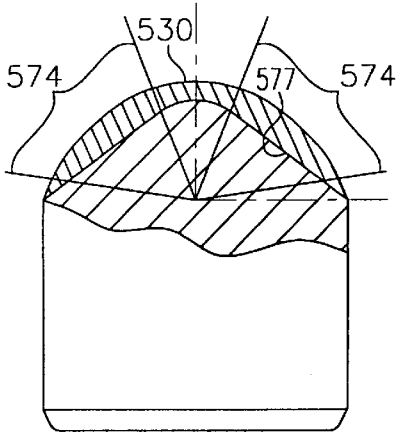

In another embodiment as shown in FIG. 5D, the insert has a non-axisymmetric chisel shaped protrusion. The chiseled-shaped protrusion has two opposite relatively planar sides which are inclined toward each other at the top of the protrusion. Each of the planar sides 577 is aligned with the critical zone 574. The critical zone with this embodiment is a "two-section" critical zone in that it spans a portion of the protrusion along each planar side 578. Each "section" of the critical zone spans preferably less than 180° around the protrusion. The PCD layer 530 outer surface is axisymmetric having a curvature that causes the PCD layer thickness to be the greatest at the critical zone. In the embodiments shown in FIGS. 5A, 5B, 5C, and 5D, the PCD maximum thickness should preferably be not less than 0.015 times and no greater than 0.25 times the insert grip diameter. As it would become apparent to one skilled in the art, the protrusion may have other non-symmetric shapes that would allow the PCD thickness to be maximum within the critical zone.

Figure 5E:
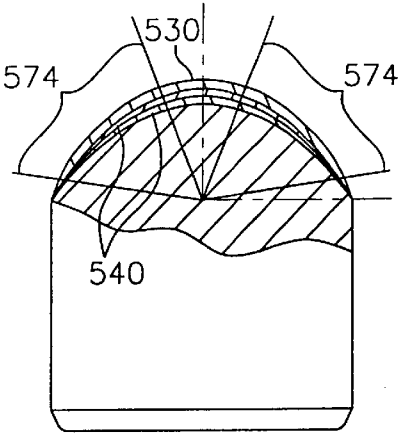
FIG. 5E depicts a partial cross-sectional view of any of the inserts shown in FIGS. 5A, 5B, 5C and 5D further including a transition layer bonded between the protrusion and the ultra hard material layer.

A transition layer or multiple transition layers 540 as shown in FIG. 5E, may be incorporated in either of the embodiments shown in FIGS. 5A, 5B, 5C and 5D. Preferably two transition layers are employed. When transition layers are incorporated, the maximum thickness of the PCD layer should preferably be no less than 0.01 times and not greater than 0.15 times the insert grip diameter.

Figure 6A:
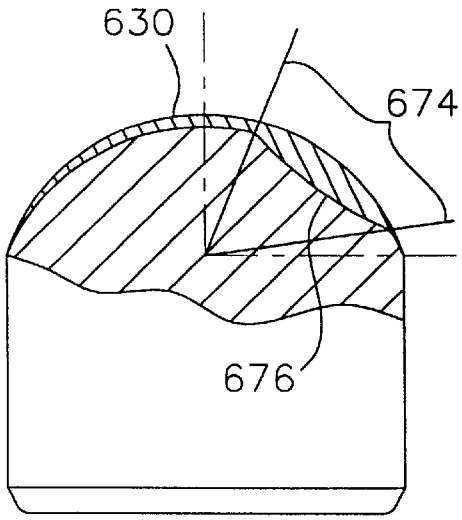
FIGS. 6A, 6B and 6C depict partial cross-sectional views of inserts each of which have non-axisymmetric protrusions on which are bonded ultra hard material layers having axisymmetric outer surfaces, wherein the protrusion surfaces within a critical zone are concave in cross-section.

The insert shown in FIG. 6A, like the insert shown in FIG. 5A has a non-axisymmetric protrusion on which is bonded a PCD layer 630 having an axisymmetric outer surface. The only difference between the two inserts is that the surface 676 of the protrusion within the critical zone 674 is concave. As with the embodiment shown in FIG. 5A, the critical zone spans a portion of the protrusion, and the PCD layer is thickest within the critical zone.

Figure 6B:
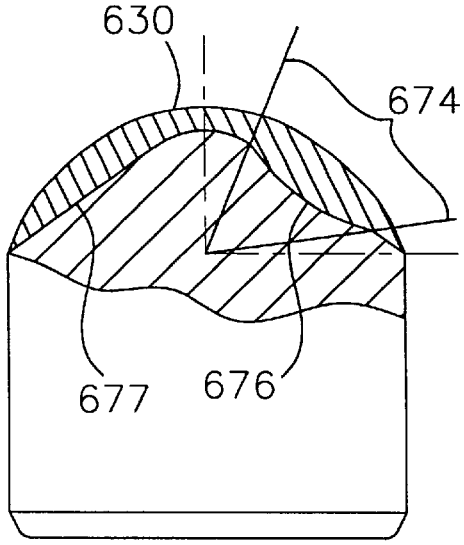
Figure 6C:
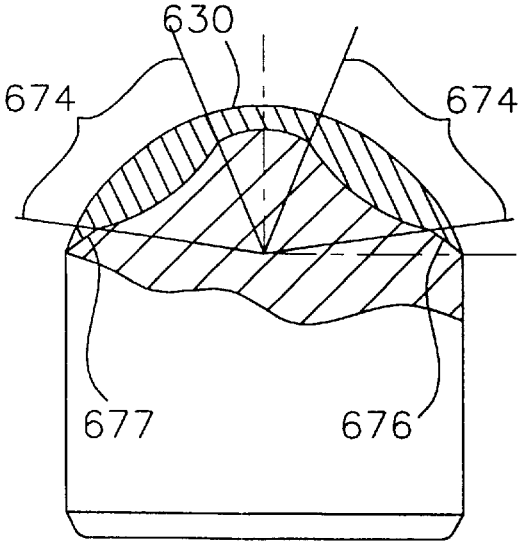

In another embodiment as shown in FIG. 6B, the protrusion is chisel-shaped non-axisymmetric similar to the chisel-shaped protrusion of the embodiment shown in FIG. 5D. With this embodiment, however, the critical zone is aligned with one of the planar sides 677. The portion 676 of the chisel planar side 677 within the critical zone 674 is concave. As it would become apparent to one skilled in the art, the critical zone span around a portion of the protrusion is typically less than 180°. The PCD layer 630 outer surface is axisymmetric having a curvature that causes the thickness of PCD to be greatest within the critical zone. Alternatively, the critical zone may span the entire protrusion circumference as shown in FIG. 6C. Further, the critical zone may be a "two-section" critical zone, having a "section" along each planar side 677 of the protrusion. In the embodiments shown in FIGS. 6A, 6B and 6C, the PCD maximum thickness should preferably be not less than 0.015 times and no greater than 0.25 times the diameter of the insert grip.

Figure 6D:
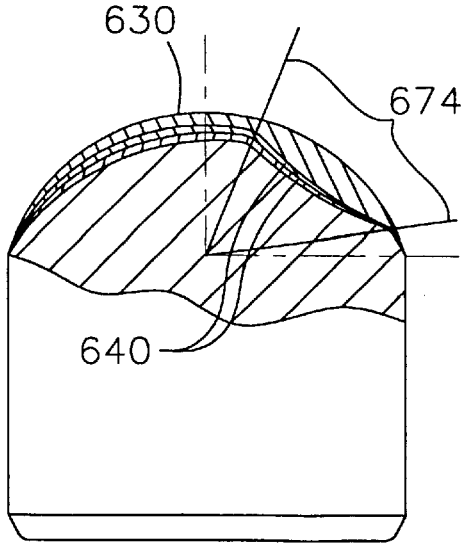
FIG. 6D depicts a partial cross-sectional view of any of the inserts shown in FIGS. 6A, 6B and 6C further including a transition layer bonded between the protrusion and the ultra hard material layer.

A transition layer or multiple transition layers 640 as shown in FIG. 6D may be incorporated with any of the embodiments of FIGS. 6A, 6B or 6C. Preferably two transition layers are employed. The transition layer should be draped in the concave surfaces so as to allow for maximum PCD layer thickness. When transition layers are incorporated, the maximum thickness of the PCD layer should preferably be no less than 0.01 times and not greater than 0.15 times the diameter of the insert grip.

Figure 7C:
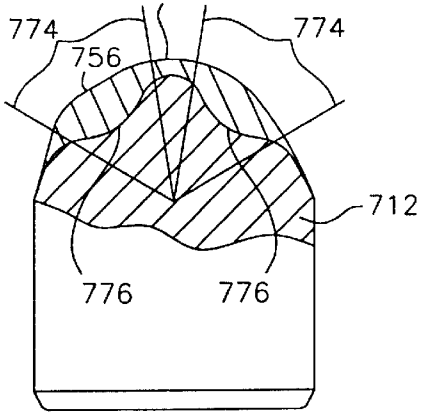
FIG. 7C depicts a partial cross-sectional view of the insert shown in FIG. 7A with a concave protrusion outer surface within the critical zone.
Figure 7B:
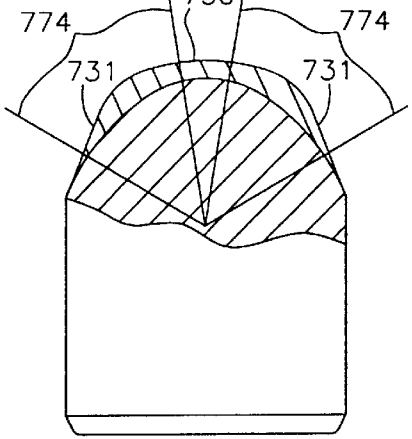
FIG. 7B depicts a partial cross-sectional view of an insert having an axisymmetric protrusion on which is bonded an ultra hard material layer having a chisel-shaped outer surface.
Figure 7A:
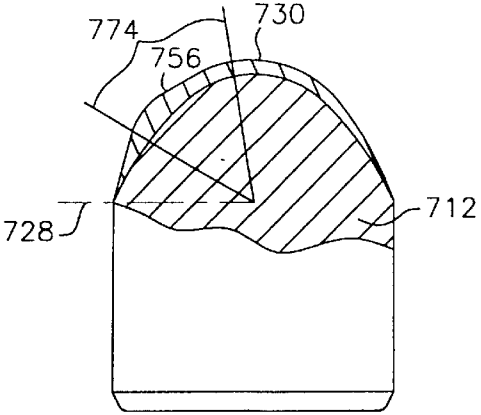
FIG. 7A depicts a partial cross-sectional view of an insert having an axisymmetric protrusion on which is bonded an ultra hard material layer having a skewed ridge.

The insert of FIG. 7A has an axisymmetric protrusion 712. A layer of PCD 730 is bonded on the protrusion. The PCD layer outer surface is non-axisymmetric and forms a ridge 750 that is skewed relative to the plane of intersection 728 between the protrusion and the grip 710. The angle at which the ridge is skewed is tailored so as to provide the maximum PCD layer thickness along a critical zone 774 which spans around a portion of the protrusion, typically less than 180°, but preferably less than 160°.

In another embodiment shown in FIG. 7B, the insert has an axisymmetric protrusion. A PCD layer 730 is formed on the protrusion. The PCD layer outer surface is chisel shaped having two relative planar sides 731 skewed toward each other. This embodiment has a "two-section" critical zone 774 wherein each of the PCD layer planar sides 731 is aligned with each "section" of the critical zone so as to provide for the greatest thickness of the PCD layer within the critical zone. As it would become apparent to one skilled in the art, the non-axisymmetric PCD layer outer surface can have other shapes that would allow for the greatest thickness of the PCD layer to be within a critical zone which may span a portion of the protrusion.

An alternate embodiment shown in FIG. 7C, is similar to the embodiment shown in FIG. 7A with the exception that the surface of the protrusion within the critical zone 774 is concave forming a concave groove 776. The groove may span the entire circumference of the protrusion as shown in FIG. 7C or may span a portion, preferably less than 160°, of the protrusion so as to encompass the entire critical zone. As it would become apparent to one skilled in the art, if the groove spans only a portion of the protrusion circumference, than the protrusion ceases to be axisymmetric. The groove allows for a further increase in the thickness of the PCD layer within the critical zone.

Figure 7E:
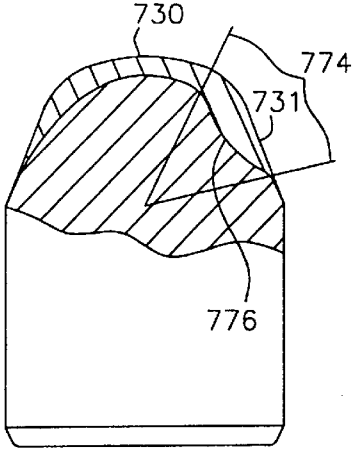
FIGS. 7D and 7E depict partial cross-sectional views of the insert of FIG. 7B with a concave protrusion outer surface within the critical zone.
Figure 7D:
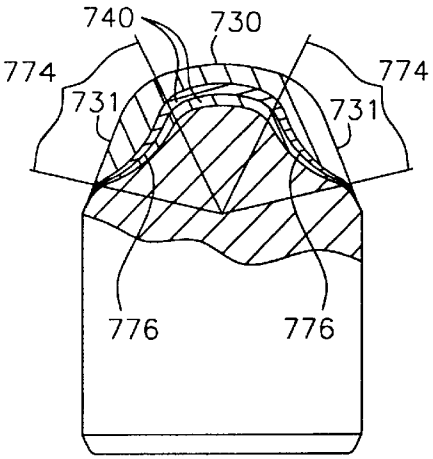

A further alternate embodiment shown in FIG. 7D, is similar to the embodiment shown in FIG. 7B with the exception that a groove having a concave bottom 776 is formed on the protrusion within the critical zone. The groove spans the entire protrusion circumference. Alternatively, the critical zone spans only a portion of the protrusion, less than 180°. but preferably less than 160°, and is aligned with one of the planar sides 731 of the PCD layer as shown in FIG. 7E. With this embodiment, the groove is formed along a critical zone 774 which spans only around a portion of the protrusion. The groove allows for a further increase in the thickness of the PCD layer within the critical zone. It should be noted that since the groove spans only a portion of the protrusion, the protrusion of the embodiment shown in FIG. 7E is no longer axisymmetric.

With any of the embodiments having an axisymmetric protrusion on which is formed a PCD layer having a non-axisymmetric outer surface, a single or multiple transition layers 740 may be incorporated between the protrusion and the PCD layer as shown in FIG. 7D. Preferably, two transition layers are employed.

Figures 8A, 8B, 8C, 8D, 8E, 8F:
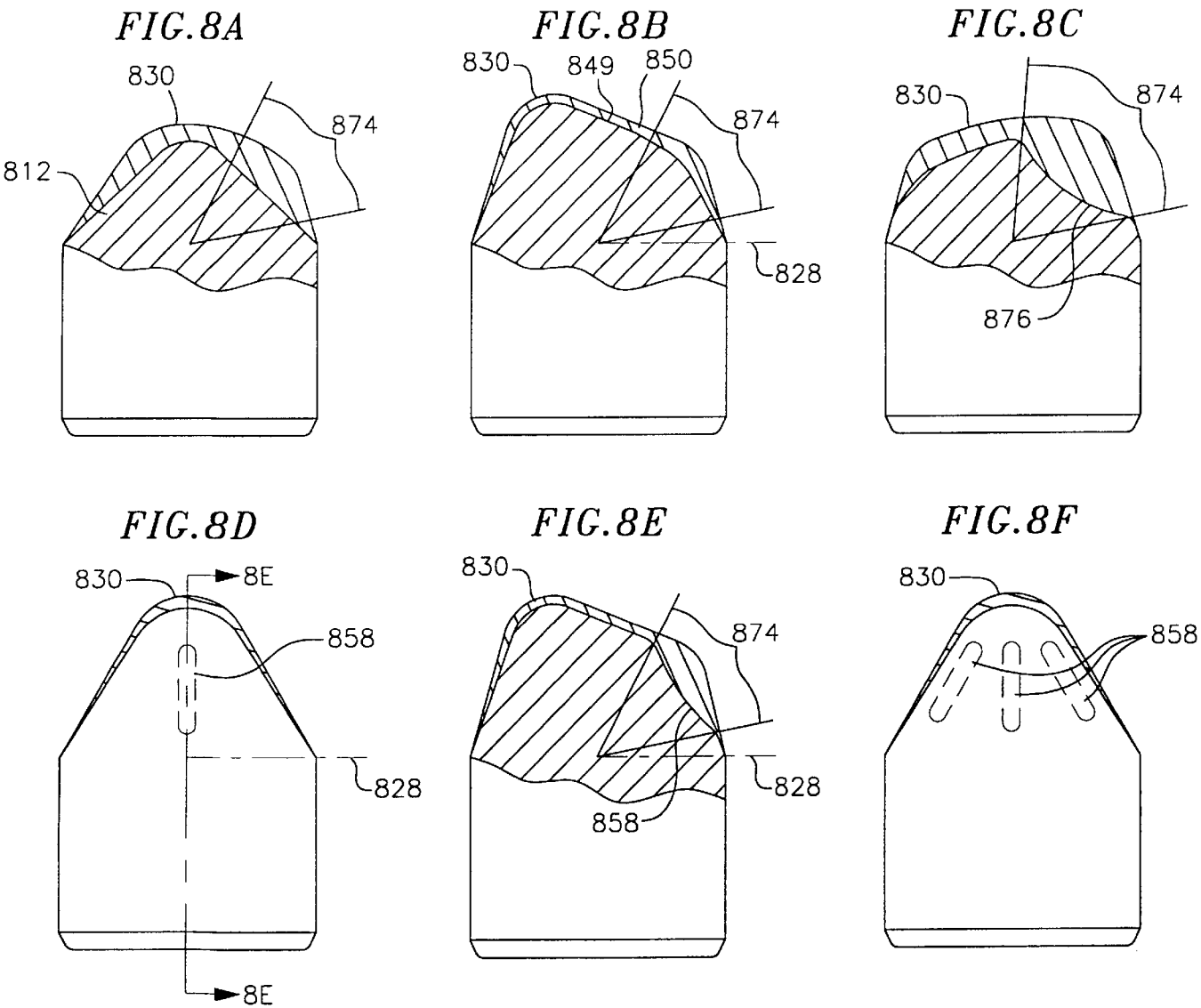
FIGS. 8A, 8B, 8C and 8D depict partial cross-sectional views of inserts having non-axisymmetric protrusions on which are bonded ultra hard material layers having non-axisymmetric outer surfaces.
FIG. 8E is a partial cross-sectional view of the insert show in FIG. 8D.
FIG. 8F is a partial cross-sectional view of an insert having multiple radial grooves formed within the critical zone.

In another embodiment, as shown in FIG. 8A, the insert has a non-axisymmetric protrusion 812. The non-axisymmetric protrusion can be any of the non-axisymmetric protrusions described above. A PCD layer 830 is formed on the protrusion. The outer surface of the PCD layer is also non-axisymmetric such that the PCD layer has the greatest thickness within a critical zone 874. For example, the protrusion may form a ridge 849 which is skewed relative to the plane of intersection 828 between the protrusion and the grip, as shown in FIG. 8B. The PCD layer outer surface which is also non-axisymmetric and may form a ridge 850 that is skewed relative to the plane of intersection 828 between the protrusion and the grip. With this embodiment, the critical zone 874 typically spans less than 180°, and preferably less than 160°, around the protrusion. Moreover, a concave circumferential depression 876 may be formed on the protrusion within the critical zone 874 which would allow for more PCD to be within the critical zone (FIG. 8C).

In a further alternate embodiment shown in FIGS. 8D and 8E, instead of a circumferential groove, a radial groove 858 is formed within the critical zone beginning near the plane of intersection 828 between the grip and the protrusion and extending radially toward the apex of the protrusion. Moreover, transition layers may be incorporated between the protrusion and the PCD layers in any of the aforementioned embodiments. Instead of single radial groove, multiple radial grooves 858 may be formed within the critical zone 874 (FIG. 8F). With these embodiments, the critical zone may span the entire protrusion circumference or may preferably be limited to portion of the circumference no greater than 160°.

Moreover, the lack of axisymmetry in the protrusions of the inserts of the embodiments depicted in FIGS. 8C, 8D and 8F may be caused by the depression (FIG. 8C) or the radial grooves (FIGS. 8D and 8F) if such depression and grooves do not span the entire circumference of the protrusion. In other words, the protrusions may be axisymmetric but for the depression or radial grooves. Furthermore, the PCD layer 830 outer surfaces may non-axisymmetric or axisymmetric. Of course as it would become apparent to one skilled in the art, the protrusion of the embodiment shown in FIG. 8F may axisymmetric or non-axisymmetric with the radial grooves located around the entire circumference of the protrusion.

Figure 9A:
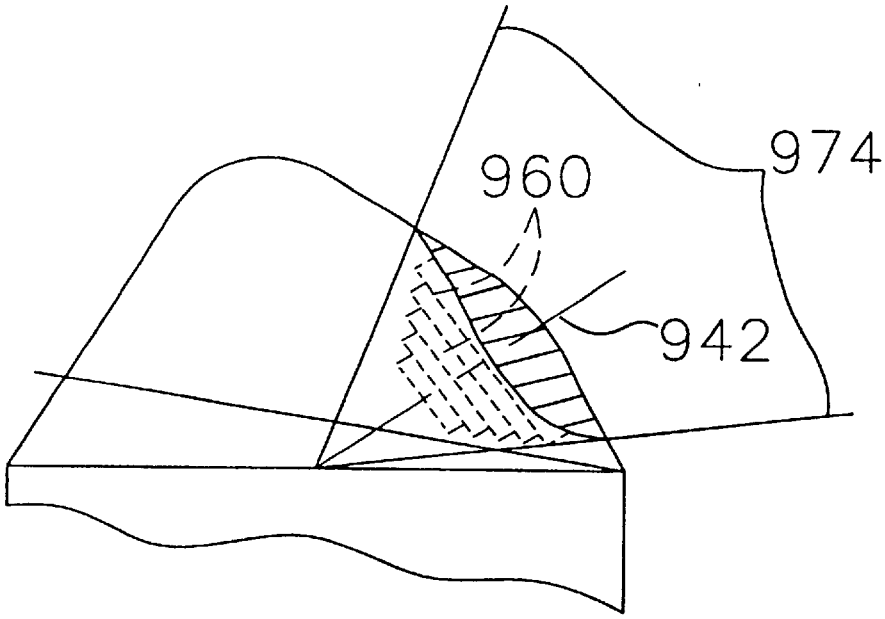
FIG. 9A is a partial side view of an insert having an non-axisymmetric protrusion having a depression which is stepped down in width along its depth and which is filled with an ultra hard material.
Figure 9B:
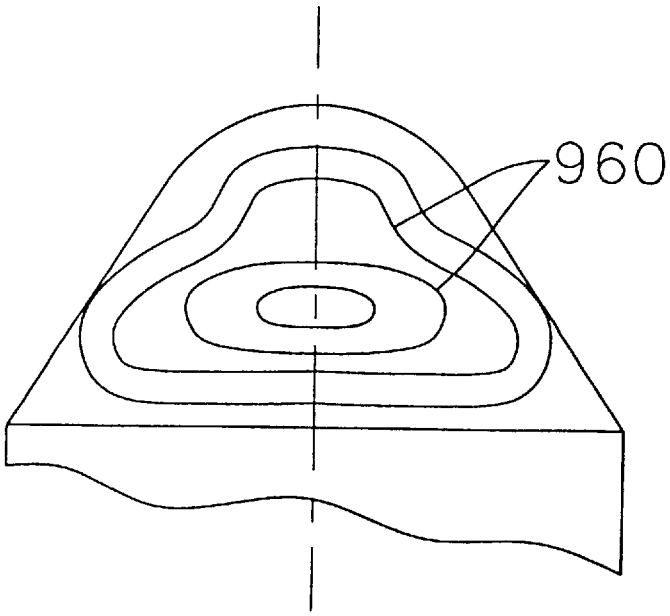
FIG. 9B is a front view of the insert as shown in FIG. 9A without the ultra hard material depicting the stepped-down depression.

The insert of FIG. 9A has a non-axisymmetric protrusion such as the insert of FIG. 8D with the exception that instead of a groove, a depression is formed within the critical zone 974 which spans around a portion of the protrusion. The cross-sectional area of the depression is incrementally stepped down to a minimum area at the depression bottom. Put differently, the cross-sectional area is maintained for a given depth of the depression and is then decreased to a smaller cross-sectional area and maintained for a further depth of the depression, and so forth. Preferably, four to ten steps 960 are incorporated in the depression (FIG. 9B). The depression is preferably filled with PCD having a grain size between 50–100 microns. It is believed that PCD having a 50–100 micron grain size is optimized for fracture toughness. The outer surface of the PCD follows the contour of the protrusion.

Alternatively, transition layers may be provided in the depression providing for a gradual change in the mechanical properties. Four to ten transition layers may be incorporated. Preferably, a single transition layer is incorporated within each step in the depression.

Figure 10A:
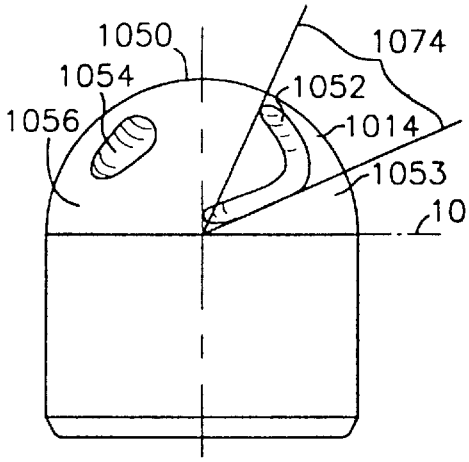
FIGS. 10A, 10B and 10C depict a side views of insert bodies having a SRT, conical and chisel shaped protrusions, respectively, having a curving groove formed on a leading surface on the protrusion and a depression formed on a trailing surface of the protrusion.
Figure 10B:
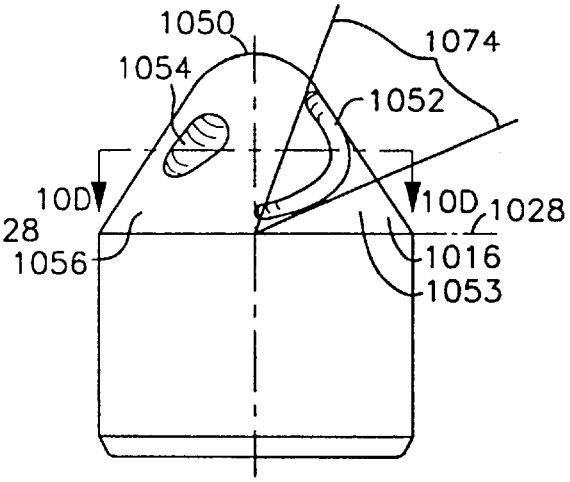
Figure 10C:
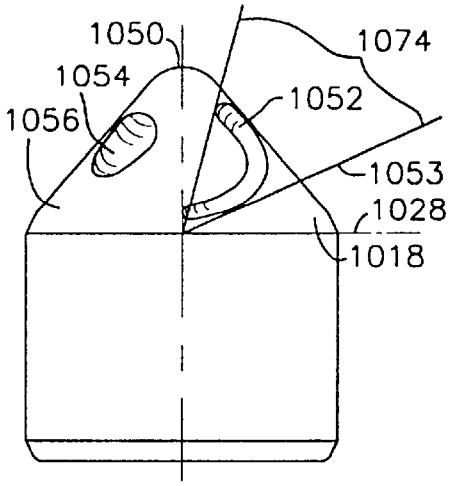
Figure 10D:
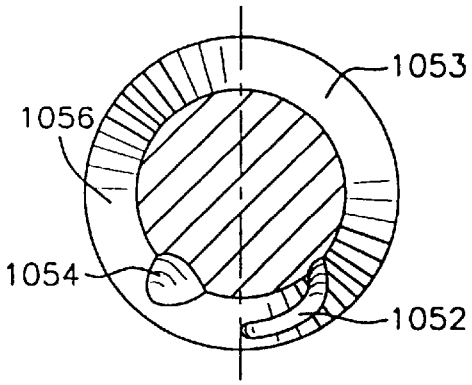
FIG. 10D is a cross-sectional view through the protrusion of the insert body shown in FIG. 10B.

FIGS. 10A, 10B, and 10C depict inserts having SRT 1014, conical 1016, and chisel-shaped 1018 convex protrusions, respectively. An arcuate groove 1052 is formed on a leading surface 1053 of each insert protrusion so as to be within the critical zone 1074. The groove preferably begins near the plane of intersection 1028 between the insert grip and the protrusion and curves upward toward the apex 1050 of the protrusion. A preferably elliptical depression 1054 is formed on the trailing surface 1056 of the protrusion, preferably less than 180° away from the groove on the leading surface. FIG. 10D depicts a cross-sectional view of the protrusion shown in FIG. 10B, showing the leading edge flank and trailing edge flank formed by the groove and depression, respectively.

Figure 10E:
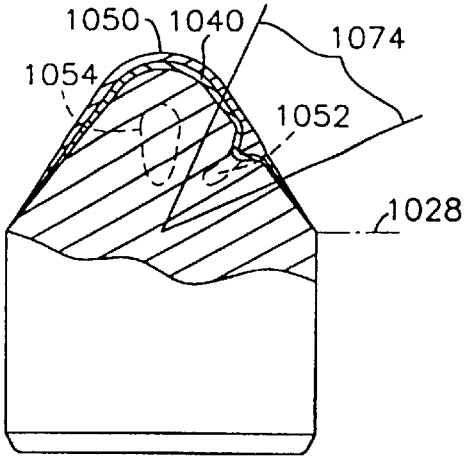
FIG. 10E is a partial cross-sectional view of the insert body shown in FIG. 10B having a transition layer formed over the protrusion and draped within the groove and depression and an ultra hard material layer over the transition layer.

A constant thickness transition layer 1026 may be formed over the protrusion and preferably draped within the groove 1052 and depression 1054 (FIG. 10E). A PCD layer 1030 having a uniform outer surface is then formed over the transition layer such that its thickness is greatest in the areas of the groove and depression. In an alternate embodiment, a transition layer is not used, i.e., the PCD layer is bonded directly to the protrusion. Moreover, as it would become apparent to one skilled in the art, the inserts may have other axisymmetric and non-axisymmetric shaped protrusions.

In roller cone applications, the protrusion region of contact changes as the bit rotates from the leading surface of the protrusion which initially contacts the earth formation to the trailing surface of the protrusion lastly contacts the earth formation. The protrusion is loaded on its leading surface and unloaded on its trailing surface and as such, these surfaces are exposed to cyclic loads during drilling. The embodiments shown in FIGS. 10A, 10B, 10C and 10E place the maximum PCD thickness in the leading and trailing surfaces to enhance the impact and wear resistance of the cutting element at those locations.

Figure 10F:
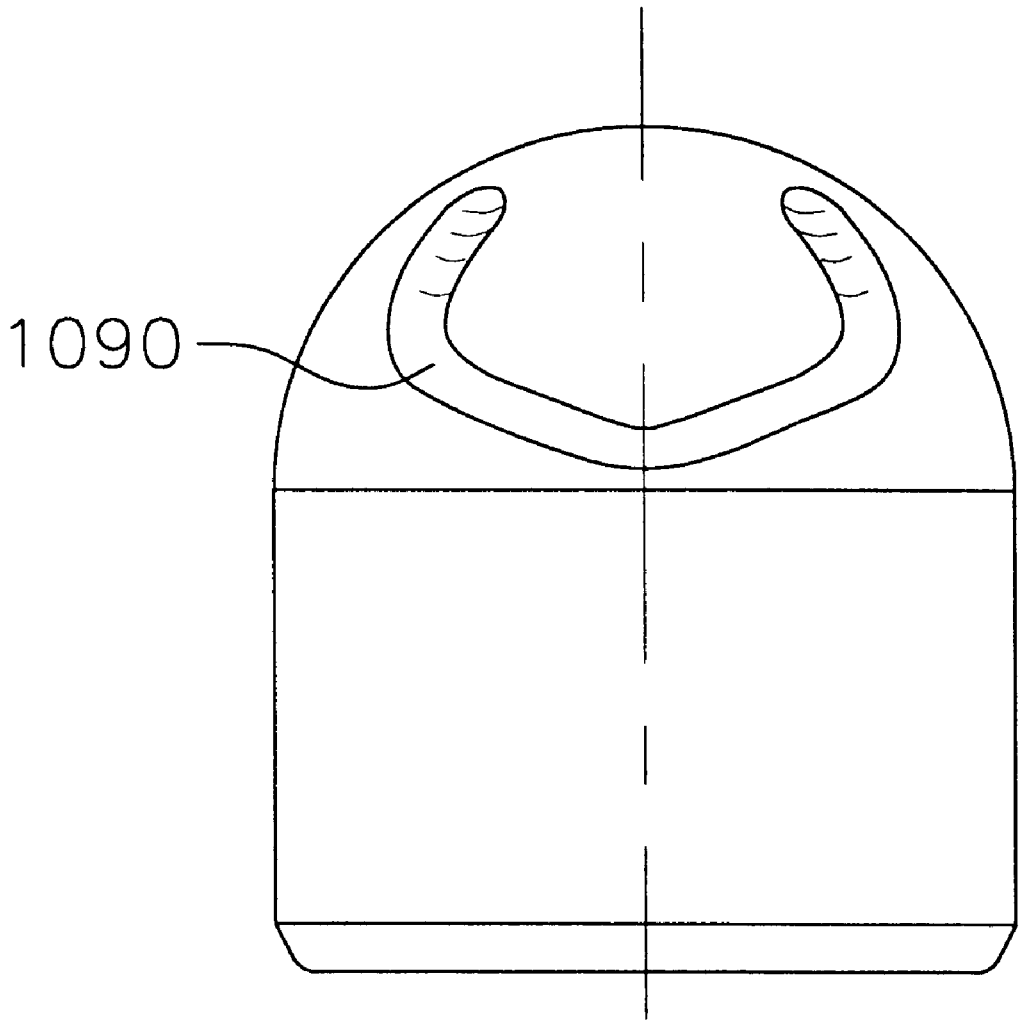
FIG. 10F is a partial cross-sectional view of an insert having groove formed on the protrusion of the insert body around part of the periphery of the critical zone.

In yet a further alternate embodiment, a groove 1090 is formed on the protrusion approximately around a portion of the critical zone periphery (FIG. 10F). Preferably the groove approximates the critical contact region. Although FIG. 10F depicts an insert substrate which with the exception of the groove has an axisymmetric protrusion, the protrusion prior to the formation of the groove may be axisymmetric or non-axisymmetric. The groove is filled with a PCD material (not shown). Alternatively, a PCD layer (not shown) is formed over the protrusion. A transition layer or multiple transition layers may be incorporated between the protrusion and the PCD layer.

Figure 1E:
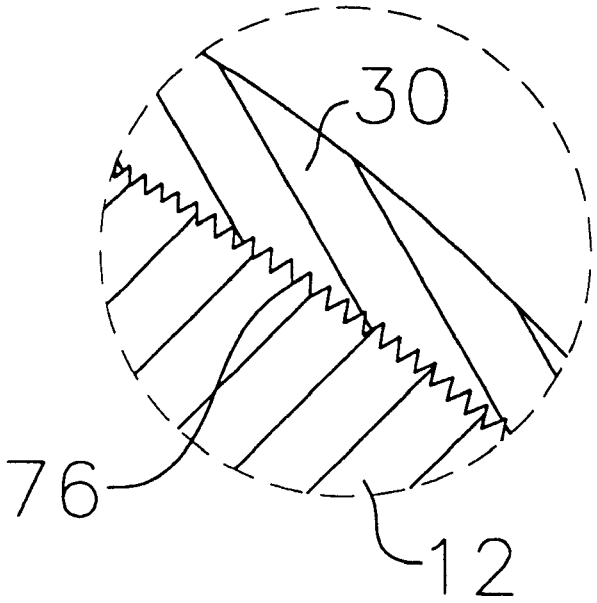
FIG. 1E depicts a protrusion outer surface which is textured within a critical zone.
Figure 1F:
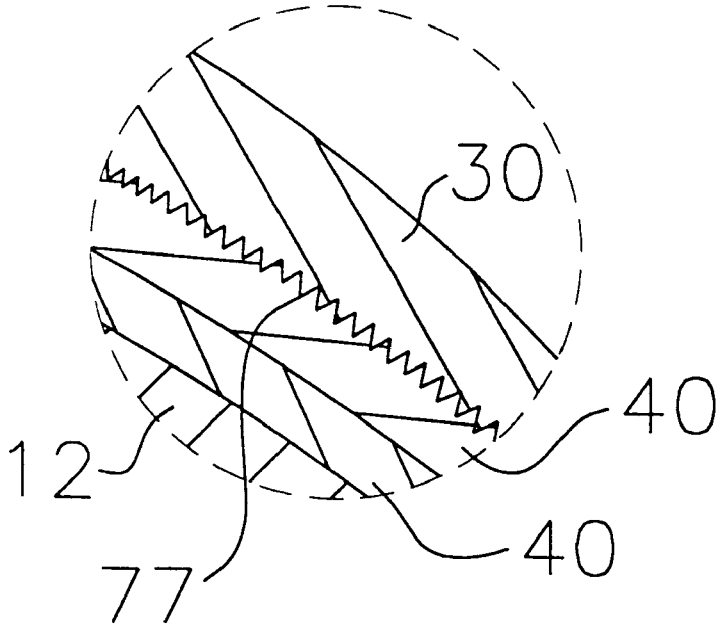
FIG. 1F depicts a transition layer outer surface which is textured within a critical zone.

With all of the aforementioned embodiments, the surface of the protrusion within the critical zone interfacing with either the PCD layer or a transition layer may be textured. Similarly, if transition layers are used the surfaces of the transition layers may also be textured. Examples of a textured protrusion outer surface 76 and of a textured transition layer outer surface 77 within the critical zone 74 are shown in FIGS. 1E and 1F, respectively.

The PCD and transition layers in all of the described embodiments are preferably bonded to the insert by a conventional high pressure/high temperature process.

What is claimed is:

1. A rock bit comprising cutting elements for cutting earth formations wherein a cutting element having a central axis is mounted on the bit for contacting the earth formation within a critical zone defined on the cutting element, wherein the cutting element comprises:

a grip portion;

a non-axisymmetric protrusion extending from an end of the grip portion; and an ultra hard material layer over the protrusion having an non-axisymmetric outer surface, wherein the critical zone is located not less than 20° and not greater than 80° from the central axis as measured from the intersection of the central axis with the plane of intersection between the protrusion and the grip, and wherein the ultra hard material layer thickness is greater within the critical zone than outside of the the critical zone, wherein the ultra hard material layer outer surface comprises a high portion defining a cutting element maximum height level as measured from a base of the grip along a longitudinal axis parallel to the central axis of the cutting element, wherein the height level of any portion of the ultra hard material layer outer surface other than the high portion as measured from the grip base along a longitudinal axis parallel to the central axis of the cutting element is not greater than the maximum height level, and wherein the outer surface of the ultra hard material layer within the critical zone does not extend to the maximum height level.

2. A rock bit as recited in claim 1 wherein the surface of the cutting element protrusion is convex within the critical zone.

3. A rock bit as recited in claim 1 wherein the surface of the cutting element protrusion is textured within the critical zone.

4. A rock bit as recited in claim 1 wherein the cutting element protrusion forms a ridge skewed relative to a plane of intersection between the grip and the protrusion.

5. A rock bit as recited in claim 1 wherein the cutting element ultra hard material layer outer surface forms a ridge skewed relative to a plane of intersection between the grip and the protrusion.

6. A rock bit as recited in claim 1 wherein the critical zone spans no more than 160° around the protrusion.

7. A rock bit as recited in claim 1 wherein the critical zone spans on are no greater than 180° around the protrusion.

8. A rock bit as recited in claim 1 wherein the cutting element further comprises at least one transition layer between the ultra hard material layer and the protrusion.

9. A rock bit as recited in claim 1 wherein the entire ultra hard material outer surface defines a convex surface.

10. A cutting element, having a central axis, for use in a rock for contacting earth formations along a critical zone offset from the central axis, comprising:

a grip portion;

a protrusion extending from an end of the grip portion, the protrusion having a non-axisymmetric outer surface; and an ultra hard material layer over the protrusion, the ultra hard material layer having a non-axisymmetric outer surface, wherein the ultra hard material layer thickness is greater within the critical zone than outside of the critical zone, wherein the ultra hard material layer outer surface comprises a high portion defining a cutting element maximum height level as measured from a base of the grip along a longitudinal axis parallel to the central axis of the cutting element, wherein the height level of any portion of the ultra hard material layer outer surface other than the high portion as measured from the grip base along a longitudinal axis parallel to the central axis of the cutting element is not greater than the maximum height level, and wherein the outer surface of the ultra hard material layer within the critical zone does not extend to the maximum height level.

11. A cutting element as recited in claim 10 wherein the ultra hard material layer is selected from the group comprising polycrystalline diamond and polycrystalline cubic boron nitride.

12. A cutting element as recited in claim 10 wherein the critical zone spans an arc no greater than 180° around the protrusion.

13. A cutting element as recited in claim 10 wherein the critical zone spans an arc no greater than 160° around the protrusion.

14. A cutting element as recited in claim 10 wherein a cross section of the cutting element protrusion comprises a linear portion within the critical zone.

15. A cutting element as recited in claim 10 comprising a plurality of critical zones arranged around the cutting element.

16. A cutting element as recited in claim 10 wherein the cutting element protrusion forms a ridge skewed relative to a plane of intersection between the grip and the protrusion and extending from the critical zone.

17. A cutting element as recited in claim 16 wherein the cutting element ultra hard material layer outer surface forms a ridge skewed relative to a plane of intersection between the grip and the protrusion and extending from the critical zone.

18. A cutting element as recited in claim 17 wherein the ultra hard material ridge is aligned with the protrusion ridge.

19. A cutting element as recited in claim 10 wherein the cutting element ultra hard material layer outer surface forms a ridge skewed relative to a plane of intersection between the grip and the protrusion and extending from the critical zone.

20. A cutting element as recited in claim 10 wherein the entire ultra hard material outer surface defines a convex surface.

* * * * *